United States Patent [19]

Tack

[11] 4,428,303

[45] Jan. 31, 1984

[54] PEDESTAL WEAR PLATE

[75] Inventor: Carl E. Tack, Elmhurst, Ill.

[73] Assignee: TransDyne, Inc., Chicago, Ill.

[21] Appl. No.: 306,090

[22] Filed: Sep. 28, 1981

[51] Int. Cl.[3] ..... B61F 5/26; B61F 15/00

[52] U.S. Cl. ..... 105/225; 105/218 R; 308/57

[58] Field of Search ..... 105/218 R, 223, 224 R, 105/225; 308/57, DIG. 6

[56] References Cited

U.S. PATENT DOCUMENTS

| | | | |
|---|---|---|---|
| 1,377,703 | 5/1921 | Lamont | 105/225 X |
| 1,476,463 | 12/1923 | Posson | 105/225 |
| 1,903,859 | 4/1933 | Glascodine | 105/225 |
| 3,897,736 | 8/1975 | Tack | 105/225 |
| 4,192,240 | 3/1980 | Korpics | 105/225 |
| 4,203,371 | 5/1980 | Tack | 105/225 |

FOREIGN PATENT DOCUMENTS

| | | | |
|---|---|---|---|
| 275025 | 8/1927 | United Kingdom | 105/225 |

*Primary Examiner*—Robert B. Reeves
*Assistant Examiner*—David F. Hubbuch
*Attorney, Agent, or Firm*—Gary, Juettner & Pyle

[57] ABSTRACT

A clip-on wear plate for protecting the downwardly facing surface in the pedestal opening of a side frame of a railway truck. The wear plate is especially adapted to be used on worn pedestal surfaces and comprises either a pair of separate plates or a plate with a central portion removed.

4 Claims, 6 Drawing Figures

PEDESTAL WEAR PLATE

BACKGROUND OF THE INVENTION

This invention relates to improvements in a wear plate that is specifically designed for convenient and removable installation in the pedestal opening of a railway truck side frame in order to prevent wear on the load bearing surface of the pedestal. The wear plates described herein represent improvements over those described in my U.S. Pat. Nos. 3,897,736 and 4,203,371.

As described in the aforesaid patents, the weight of a railway vehicle is supported upon wheel and axle assemblies wherein the axles carry roller bearing assemblies to minimize friction. An insert is provided between the outer bearing rack and the pedestal opening in the side frame, which is referred to as a bearing adaptor. The purpose of the adaptor is not only to complete the support structure, but also to equalize or distribute the load placed on the roller bearing.

The bearing adaptor has an upper surface that is in direct engagement with the downwardly facing surface in the pedestal opening. In service, limited movement or frictional sliding occurs between the bearing adaptor and the pedestal surface, which causes the frame surface to become worn. Excessive wear results in sloppiness between the axle and frame and weakening of the frame at a critical load bearing location. Repair of the frame surface is both expensive and time consuming, since the worn surface must be ground flat and renewed by welding a flat plate into the opening.

The clip-on wear plates described in the aforesaid U.S. Pat. Nos. 3,897,736 and 4,203,371 prevent wear on the frame surface if they are installed on a new frame or a reconditioned frame. A problem arises, however, when attempting to install such wear plates over a previously worn surface. If the surface is not flat or is uneven, the wear plate will not ride solidly in the opening and will be stressed unevenly, which may cause failure in highly stressed areas.

The upper surface of the bearing adaptor has a central recess therein extending parallel to the axle, whereby the load is borne on relatively raised surfaces or lands on either side of the recess to ensure proper force distribution to the bearing assembly. Wear is thus confined primarily to lands and the corresponding bearing surfaces on the frame. Under excessive wear conditions, the entire upper surface of the bearing adaptor may engage the frame, causing the bearings to become pinched and overheated.

SUMMARY OF THE INVENTION

The present invention provides a clip-on type pedestal wear plate or wear plate assembly that is particularly adapted to accommodate partially worn conditions on the pedestal surface. It has been observed that the wear in the pedestal surface will occur primarily at each side where the raised land engages the surface, whereas the central portion of the surface will remain relatively unworn.

In accordance with the present invention, a pair of wear plates are provided and have a central space therebetween, thus allowing for secure installation against a partially worn frame surface. The wear plate may take the form of two separate plates which are installed in a spaced relation, or a single member in which a central portion of the plate has been removed.

THE DRAWINGS

DESCRIPTION OF THE PREFERRED EMBODIMENTS

Figure 2:
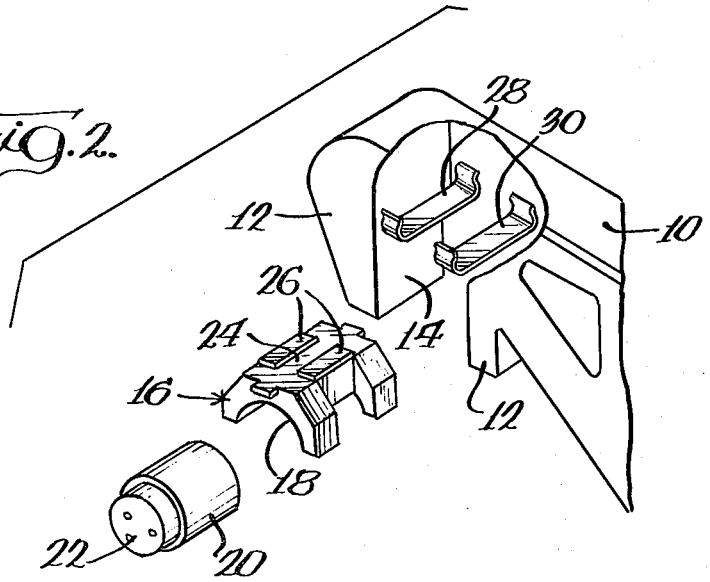
FIG. 2 is a perspective view, with parts broken away to review internal structure, illustrating installation of the wear plate means of FIG. 1 into a railway vehicle.

Referring first to FIG. 2, the portion of a railway vehicle of concern to the present invention is the side frame 10 having a pair of downwardly depending jaws 12 at each end defining the pedestal opening 14. Received within opening 14 and against the downwardly facing surface thereof is a bearing adaptor 16 having a lower curved surface 18 disposed over and partially around a roller bearing 20, which, in turn is disposed around an axle 22 in the conventional fashion.

As shown in FIG. 2, the bearing adaptor 16 has an upper load bearing surface comprising a central groove 24 extending parallel to the axis of the axle and a pair of relatively raised lands 26 disposed on either side of the groove. It may therefore be seen that wear between the bearing adaptor and pedestal surface or wall will take place primarily on the lands 26 and the area of the pedestal wall bearing against the lands.

In accordance with existing standards, a certain amount of wear on the pedestal wall is acceptable, but beyond a stated minimum, the wall must be restored to flatness by grinding. It may be seen that the area above the groove 24 of the adaptor 16 will receive relatively less wear.

Figure 1:
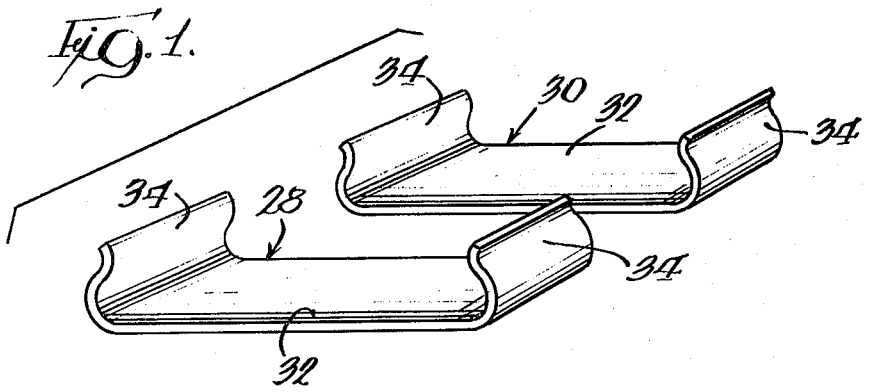
FIG. 1 is a perspective view of one embodiment of the wear plate means of the present invention.
Figure 3:
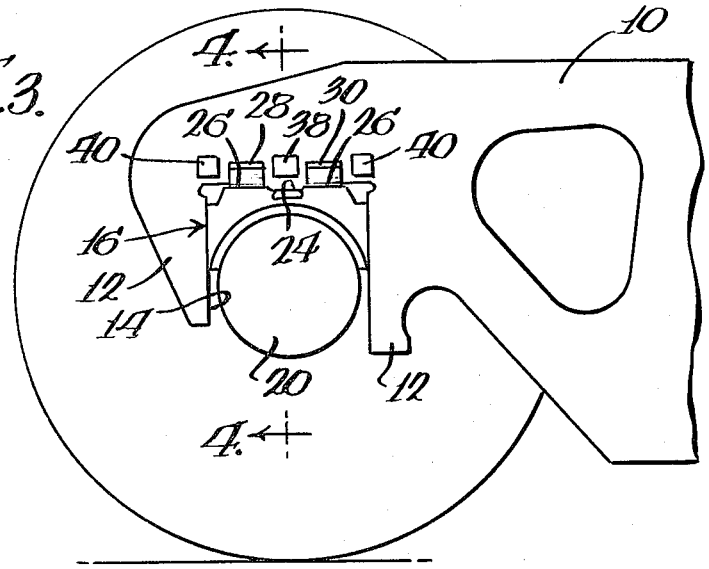
FIG. 3 is a side view of a portion of a railway vehicle illustrating completed installation of the wear plate means of FIG. 1.

In the preferred embodiment of the present invention, wear plate means are provided to accommodate conditions of wear to be expected in the pedestal. As shown in FIGS. 1 through 3, a pair of clip-on wear plates 28 and 30 are installed at opposite sides of the pedestal opening such that there is an open space or gap between the wear surfaces of the plates.

Figure 4:
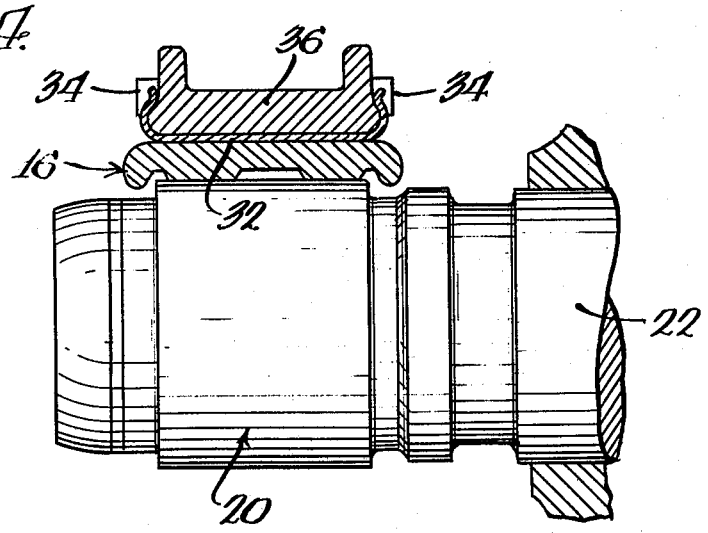
FIG. 4 is a sectional view taken along line 4—4 of FIG. 3.

The basic construction of the wear plates 28 and 30 is similar to that described in my prior U.S. Pat. Nos. 3,897,736 and 4,203,371. In the present embodiment, the two plates are substantially identical, with each plate comprising a base plate 32 having a pair of resilient lips or flanges 34 disposed on the sides of the base. As shown in FIG. 4, the wear plates are installed by forcing each plate upward against the downwardly facing wall 36 of the side frame in the pedestal opening. The distance between the resilient lips 34 is such that the plate clamps onto the frame and is retained thereon by the lips until the truck is assembled.

As shown in FIG. 3, means are provided to retain the wear plate means in a spaced relation relative to one another, the effect of which is to maintain a gap or space above the central portion of the bearing adaptor and avoid contact of each of the plates with a relatively unworn surface of the pedestal wall. Thus, the facing edges of the plates are preferably spaced somewhat wider than the central groove 24 in the adaptor to minimize possible contact with an irregular surface. For this purpose, means are provided between the facing edges of the lips 34 to hold the plates 28 and 30 in a spaced relation. In the present embodiment, such means preferably comprises a stop lug 38 secured, such as by welding, to the opposite sides of the side frame immediately above the pedestal opening and centrally thereof.

It may be seen in FIG. 3 that the lug 38 serves to retain the plates 28 and 30 in a spaced horizontal position relative to each other and prevents the plates from migrating into the unworn area of the pedestal wall, which would cause undue stress on the plates and bearing adaptor.

In order to restrain the plates against outward longitudinal movement, a stop lug 40 is secured or welded adjacent the outer edges of the lips 34 of each plate immediately above the pedestal opening and on both sides of the frame. The outer lugs 40 are located to engage the outer edges of the lips and prevent outward migration against the sides of the pedestal opening.

It may be seen that when the railway truck is disassembled for inspection of the pedestal, renewal of the pedestal wall may be easily effected by locating and securing the lugs 38 and 40 on both sides of the frame, and then applying the wear plates 28 and 30 as aforesaid.

Figure 5:
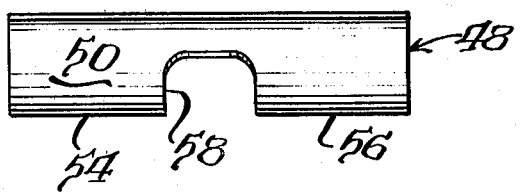
FIG. 5 is a side view of another embodiment of the wear plate means of the present invention.
Figure 6:
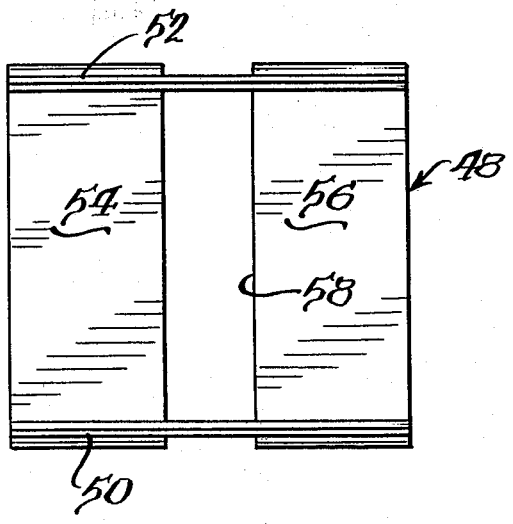
FIG. 6 is a plan view of the wear plate means shown in FIG. 5.

FIGS. 5 and 6 show another embodiment that utilizes a unitary construction rather than a pair of plates described previously. In this embodiment, a single wear plate 48 is employed, but a portion of the bottom wall and side lips are removed or eliminated from the structure. As shown, therefore, the wear plate will comprise a pair of resilient side lips 50 and 52 extending upward from a base wall that is divided into two portions 54 and 56, said portions being spaced from each other by means of an axial groove or cut-out area 58 in the center of the plate.

The perforation or cut-out portion 58 in the plate is limited to the base wall and perhaps a portion of the lips immediately above the base wall, such that the lips are continuous in the upper portions thereof and define, in effect, a pair of spaced wear plates interconnected at the lips.

Referring again to FIG. 3, it will be seen that it would not be necessary to employ a central stop lug 38 with the present embodiment, since the unitary construction retains the plates in a spaced relationship. Preferably, however, some means, such as the end stops 40, are employed to prevent the plate 48 from moving to either side under service conditions.

I claim:

1. In a wear plate of the type having a base and a pair of resilient lips extending from the base and being resiliently clamped over the downwardly facing surface in the pedestal opening of the side frame of a railway truck in order to protect the entire surface, said surface being otherwise subject to wear at longitudinally spaced areas beyond both sides of a central portion thereof, the improvement comprising a pair of individual wear plates spaced longitudinally and engaged over and protecting respective of said spaced areas of said downwardly facing surface on either side of said central portion thereof, each of said wear plates having a base wall and a pair of lips joined to and extending upward from opposite sides of said base wall, said lips being resiliently engageable in clamped relation with opposite sides of said pedestal above the downwardly facing surface thereof, and means for holding said wear plates in said longitudinally spaced relation.

2. The improvement of claim 1 wherein the means for holding said wear plates in said longitudinally spaced relation comprises a stop affixed to said side frame above the pedestal opening and located between the lips of said respective wear plates.

3. The improvement of claim 1 additionally comprising means for limiting outward longitudinal movement of said wear plates.

4. The improvement of claim 3 wherein said means for limiting outward longitudinal movement of said wear plates comprises a pair of stops affixed to said side frame and being engageable with the outside edges of said lips.

* * * * *